US008602110B2

(12) United States Patent
Kuo et al.

(10) Patent No.: US 8,602,110 B2
(45) Date of Patent: Dec. 10, 2013

(54) EXTERNALLY ADJUSTABLE INFLOW CONTROL DEVICE

(75) Inventors: Nicholas A. Kuo, Dallas, TX (US); Luke W. Holderman, Plano, TX (US); Jean-Marc Lopez, Plano, TX (US); Caleb T. Warren, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/557,934

(22) Filed: Jul. 25, 2012

(65) Prior Publication Data

US 2013/0037276 A1 Feb. 14, 2013

(30) Foreign Application Priority Data

Aug. 10, 2011 (WO) ..... PCT/US2011/047225

(51) Int. Cl.
*E21B 43/08* (2006.01)

(52) U.S. Cl.
USPC ..... 166/373; 166/205; 166/378

(58) Field of Classification Search
USPC ..... 166/169, 373, 378, 386, 205
See application file for complete search history.

(56) References Cited

U.S. PATENT DOCUMENTS

| | | | |
|---|---|---|---|
| 5,435,393 | A | 7/1995 | Brekke et al. |
| 5,803,179 | A | 9/1998 | Echols et al. |
| 6,622,794 | B2 | 9/2003 | Zisk, Jr. |
| 7,416,026 | B2 | 8/2008 | Naquin et al. |
| 7,469,743 | B2 | 12/2008 | Richards |
| 7,559,375 | B2 | 7/2009 | Dybevik et al. |
| 7,708,068 | B2 | 5/2010 | Hailey, Jr. |
| 7,802,621 | B2 | 9/2010 | Richards et al. |
| 2006/0027377 | A1* | 2/2006 | Schoonderbeek et al. .... 166/386 |
| 2008/0283238 | A1 | 11/2008 | Richards et al. |
| 2008/0314590 | A1 | 12/2008 | Patel |
| 2009/0000787 | A1 | 1/2009 | Hill et al. |
| 2009/0151925 | A1 | 6/2009 | Richards et al. |
| 2009/0218103 | A1 | 9/2009 | Aakre et al. |

OTHER PUBLICATIONS

Search Report issued Feb. 12, 2012 for International Application PCT/US11/47225, 5 pages.
Written Opinion issued Feb. 17, 2012 for International Application PCT/US11/47225, 3 pages.
Halliburton; "Simulation Software for EquiFlow® ICD Completions", H07010, dated Sep. 2009, 2 pages.
Schlumberger; "FluxRite Inflow Control Device", 09-SM-0010, dated 2009, 2 pages.
Tejas; "Inflow Control Device Technology", undated, 2 pages.

(Continued)

*Primary Examiner* — Brad Harcourt
(74) *Attorney, Agent, or Firm* — Smith IP Services, P.C.

(57) ABSTRACT

A flow regulating system can include multiple flow restrictors, at least one of which selectively restricts flow between an interior of a tubular string and an external annulus, a plug which prevents flow through a respective one of the flow restrictors, the plug being aligned substantially perpendicular to a longitudinal axis of the flow restrictor. A method of variably restricting fluid flow in a well can include installing one or more plugs in selected one(s) of multiple openings in a housing, each installed plug preventing fluid flow through a respective flow restrictor, and externally accessing the openings, without removing any cover. An externally adjustable inflow control device can include a housing having multiple openings, multiple flow restrictors, a plug in selected one(s) of the openings, each plug preventing fluid flow through a respective flow restrictor, and each plug being externally accessible, without removal of any cover.

23 Claims, 5 Drawing Sheets

(56) References Cited

OTHER PUBLICATIONS

Weatherford; "Combating Coning by Creating Even Flow Distribution in Horizontal Sand-Control Completions", 2980.02, dated 2005-2008, 4 pages.
International Search Report with Written Opinion issued Jan. 5, 2012 for PCT Patent Application No. PCT/US11/047939, 8 pages.
International Search Report with Written Opinion issued Feb. 17, 2012 for International Patent Application No. PCT/US11/047225, 8 pages.
Office Action issued Jun. 5, 2012 for U.S. Appl. No. 13/430,370, 10 pages.
Specification and Drawings for U.S. Appl. No. 13/557,934, filed Jul. 25, 2012, 25 pages.
Specification and Drawings for PCT Patent Application No. PCT/US11/47225, filed Aug. 10, 2011, 22 pages.
Office Action issued Jun. 5, 2012 for U.S. Appl. No. 12/873,840, 20 pages.
International Search Report with Written Opinion issued Feb. 17, 2012 for PCT Patent Application No. PCT/US11/047225, 8 pages.
Office Action issued Jun. 5, 2012 for U.S. Appl. No. 12/430,370, 10 pages.
Baker Hughes; "Equalizer Technology", company product presentation, dated Nov. 5, 2009, 29 pages.
Halliburton; "EquiFlow Adjustable Inflow Control Device", H07008, dated May 2011, 2 pages.
Reslink; "ResFlow Well Production Management System", version 02.05, dated 2005, 4 pages.
Weatherford; "Combating Coning by Creating Even Flow Distribution in Horizontal Sand-Control Completions", No. 2980.02, dated 2005-2008, 4 pages.
Office Action issued Jul. 30, 2013 for U.S. Appl. No. 13/430,370, 16 pages.
Office Action issued Dec. 7, 2012 for U.S. Appl. No. 13/430,370, 28 pages.

* cited by examiner

EXTERNALLY ADJUSTABLE INFLOW CONTROL DEVICE

CROSS-REFERENCE TO RELATED APPLICATION

This application claims the benefit under 35 USC §119 of the filing date of International Application Serial No. PCT/US11/47225 filed 10 Aug. 2011.The entire disclosure of this prior application is incorporated herein by this reference.

BACKGROUND

This disclosure relates generally to equipment utilized and operations performed in conjunction with a subterranean well and, in an example described below, more particularly provides for convenient external adjustment of an inflow control device.

An inflow control device is used to restrict flow of fluid produced from an earth formation. It would be beneficial to be able to conveniently and quickly adjust a restriction to flow through an inflow control device. Such improvements in adjustability would also be applicable whether fluid is produced from, injected into, or otherwise flowed in a well.

SUMMARY

In the disclosure below, a flow regulating system and associated methods are provided which bring improvements to the art. One example is described below in which openings are externally accessible on an inflow control device. Another example is described below in which elements such as plugs and closures can be conveniently installed, without a need to disassemble a housing to gain access to openings for the plugs and closures.

In one aspect, the disclosure below describes a flow regulating system for use with a subterranean well. In one example, the system can include: multiple tubular structures, at least one of which selectively restricts flow between an interior of a tubular string and an annulus external to the tubular string. At least one plug prevents flow through a respective one of the tubular structures. The plug is aligned substantially perpendicular to a longitudinal axis of the respective tubular structure.

In another aspect, a method of variably restricting fluid flow in a well is described below. In one example, the method can include installing one or more plugs in a selected at least one of multiple openings in a housing, each installed plug preventing fluid flow through a respective one of multiple tubular structures, and externally accessing the multiple openings in the housing, without removing any cover.

In yet another aspect, described below is an externally adjustable inflow control device. In one example, the inflow control device can include a housing having multiple openings formed therein, multiple tubular structures in the housing, one or more plugs in a selected at least one of the openings, each plug preventing fluid flow through a respective one of the tubular structures, and each plug being externally accessible on the housing, without removal of any cover.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
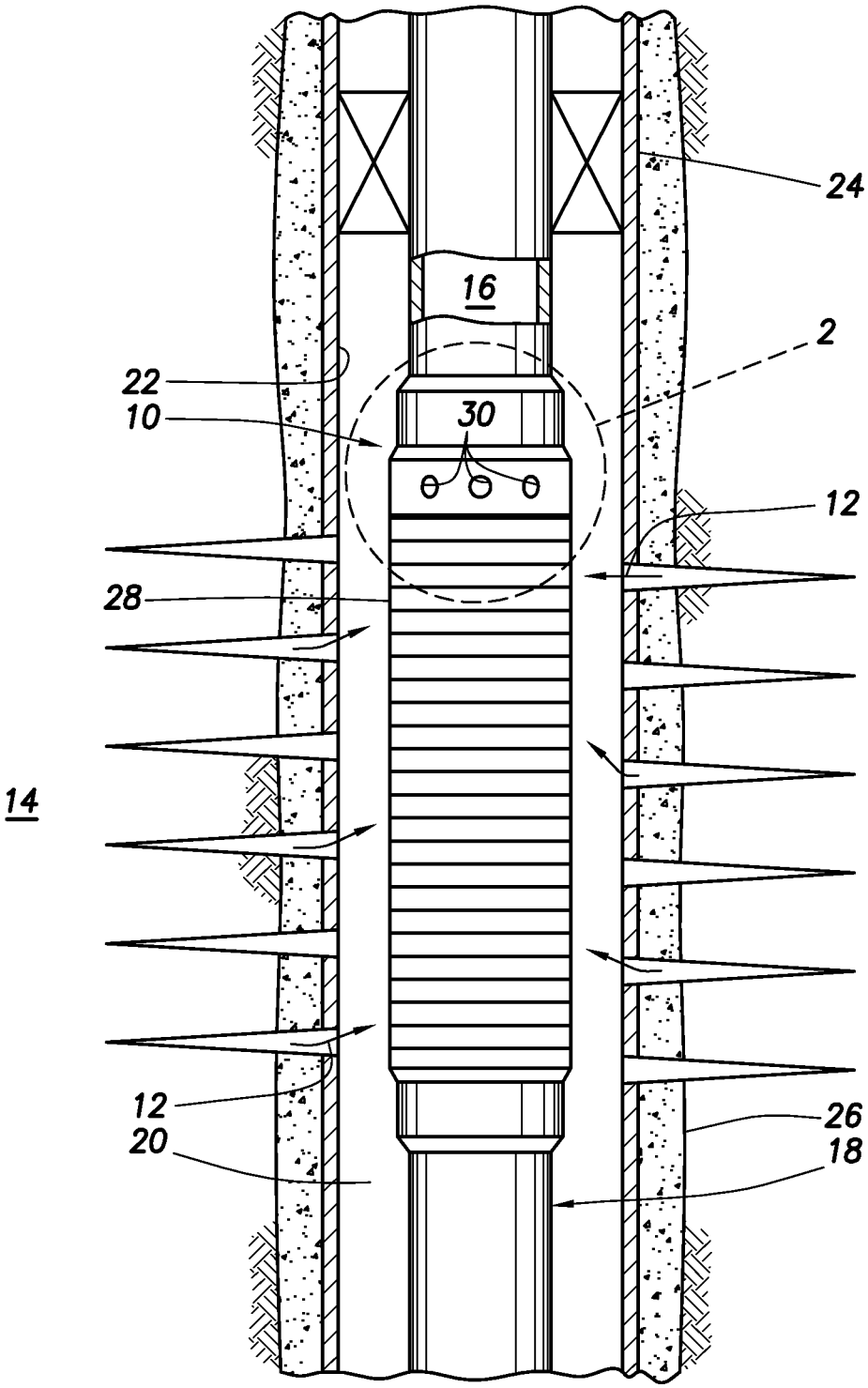
FIG. 1 is a representative partially cross-sectional view of a flow regulating system and associated method which can embody principles of this disclosure.

Representatively illustrated in FIG. 1 is a flow regulating system 10 and associated method which can embody principles of this disclosure. In this example, the system 10 is used to variably restrict flow of fluid 12 from a formation 14 to an interior flow passage 16 of a tubular string 18 (such as a production tubing string, liner string, etc.).

An annulus 20 is formed radially between the tubular string 18 and a wellbore 22 lined with casing 24 and cement 26. The fluid 12 flows from the formation 14 into the annulus 20, then into a well screen 28 which filters the fluid, through the flow regulating system 10, and then into the flow passage 16 for eventual production to the surface.

At this point, it should be emphasized that the flow regulating system 10 and its use in the wellbore 22 as depicted in FIG. 1 are merely examples of a vast number of possible variations which can incorporate the principles of this disclosure. As such, it should be clearly understood that the scope of this disclosure is not limited at all to the details of the various elements, devices and systems illustrated in the drawings and described herein.

For example, it is not necessary for the wellbore 22 to be cased, cemented or vertical as depicted in FIG. 1. It is also not necessary for the fluid 12 to flow from the formation 14 to the flow passage 16, since in injection, conformance or other operations, fluid can flow in an opposite direction. It is not necessary for the fluid 12 to flow through the well screen 28, or for the fluid to flow through the well screen prior to flowing through the flow regulating system 10. These are but a few of the vast number of changes which can be made to the well depicted in FIG. 1, while still remaining within the scope of this disclosure.

Note that the flow regulating system 10 has openings 30 thereon which are externally accessible prior to and during installation of the system in the wellbore 22. These openings 30 provide for convenient adjustment of a restriction to flow through the system 10, as described more fully below.

Figure 2:
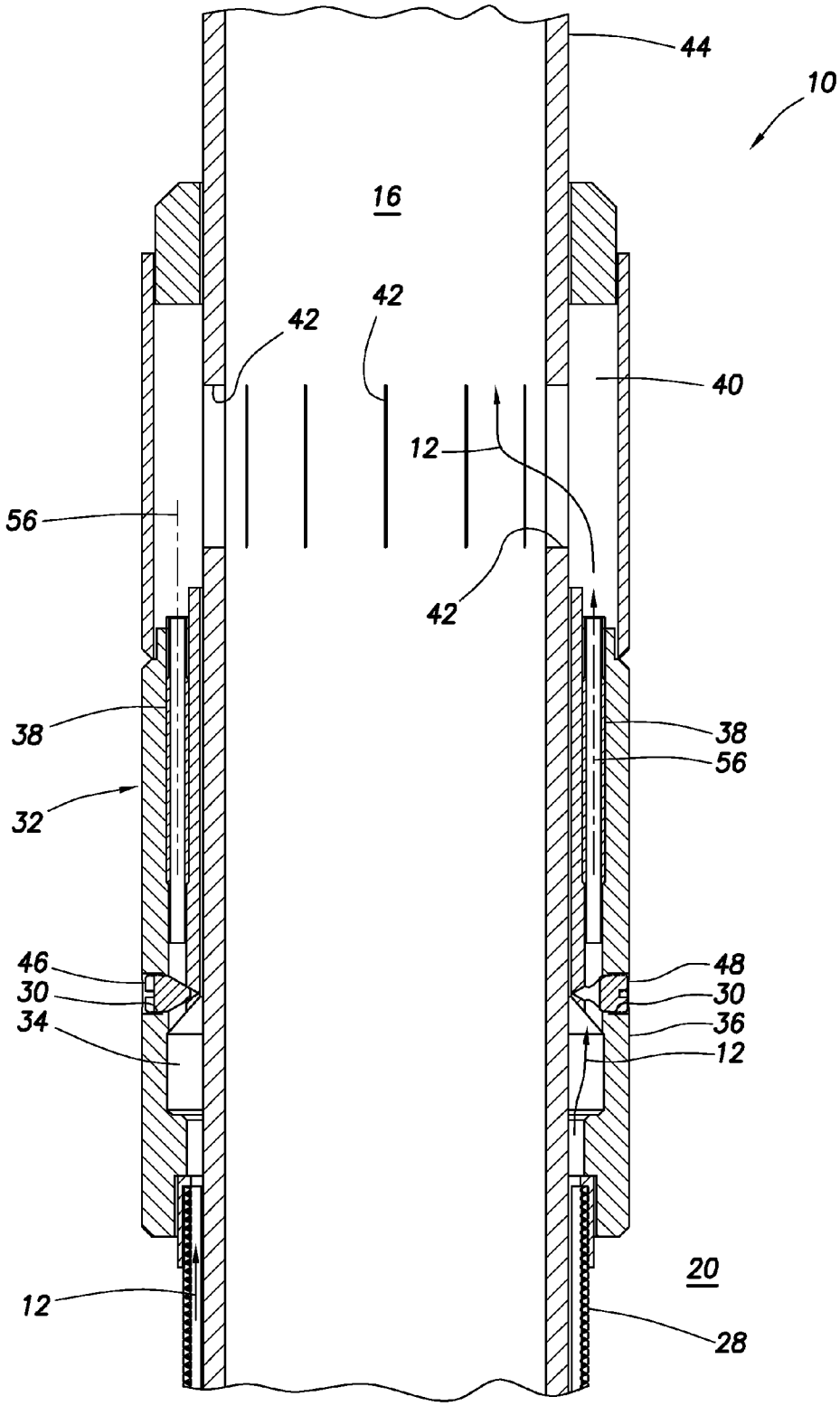
FIG. 2 is a representative enlarged scale cross-sectional view of detail '2' in FIG. 1.

Referring additionally now to FIG. 2, a more detailed enlarged scale view of the flow regulating system 10 is representatively illustrated. The system 10 may be used in the well configuration of FIG. 1, but it should be understood that the system can be used with other wells, other types of wells, other configurations, etc., in keeping with the principles of this disclosure.

In this example, the well screen 28 is depicted as a wire-wrapped filter through which the fluid 12 flows prior to entering an inflow control device 32 of the flow regulating system 10, but other types of screens (such as sintered, pre-packed, expandable, etc.) may be used, if desired. In other examples, a well screen 28 may not be used at all, the well screen could be downstream of the inflow control device 32, etc.

The fluid 12 is received from the well screen 28 into an annular chamber 34 in an outer housing 36 of the inflow control device 32. From the chamber 34, the fluid 12 flows through one or more of multiple tubular structures 38 which restrict such flow.

Although only two of the tubular structures are visible in FIG. 2, this example preferably includes a series of the tubular structures arranged in parallel, and circumferentially spaced apart in the housing 36. As described more fully below, by selecting how many of the tubular structures 38 the fluid 12 is permitted to flow through, an overall resistance to flow of the fluid through the inflow control device 32 can be varied.

The tubular structures 38 are one example of flow restrictors which may be used in the inflow control device 32. Other examples include (but are not limited to) chokes, orifices, nozzles, etc. Any type of flow restrictor may be used in keeping with the scope of this disclosure.

In this example, the fluid 12 flows through the selected open tubular structures 38 to another annular chamber 40. Thus, the tubular structures 38 provide for parallel flow of the fluid 12 from the chamber 34 to the chamber 40.

The fluid 12 flows from the chamber 40 inward via openings 42 to the flow passage 16. The openings 42 are formed radially through a base pipe 44 which is configured (e.g., with threads at either end, etc.) for interconnection in the tubular string 18.

As depicted in FIG. 2, a plug 46 prevents flow of the fluid 12 through a selected one of the tubular structures 38. This operates to increasingly restrict flow of the fluid 12 through the device 32, since fewer of the tubular structures are now available for flow of the fluid.

Also depicted in FIG. 2 is a closure 48 installed in one of the openings 30. The closure 48 prevents direct fluid communication between the associated tubular structure 38 and the annulus 20 exterior to the housing 36 (thereby preventing the fluid from bypassing the screen 28), but the closure does not prevent the fluid 12 from flowing through the tubular structure from the chamber 34. Thus, as more closures 48 (and fewer plugs 46) are installed in the openings 30, more of the tubular structures 38 are open to flow, and restriction to flow through the inflow control device 32 is reduced.

Figure 3:
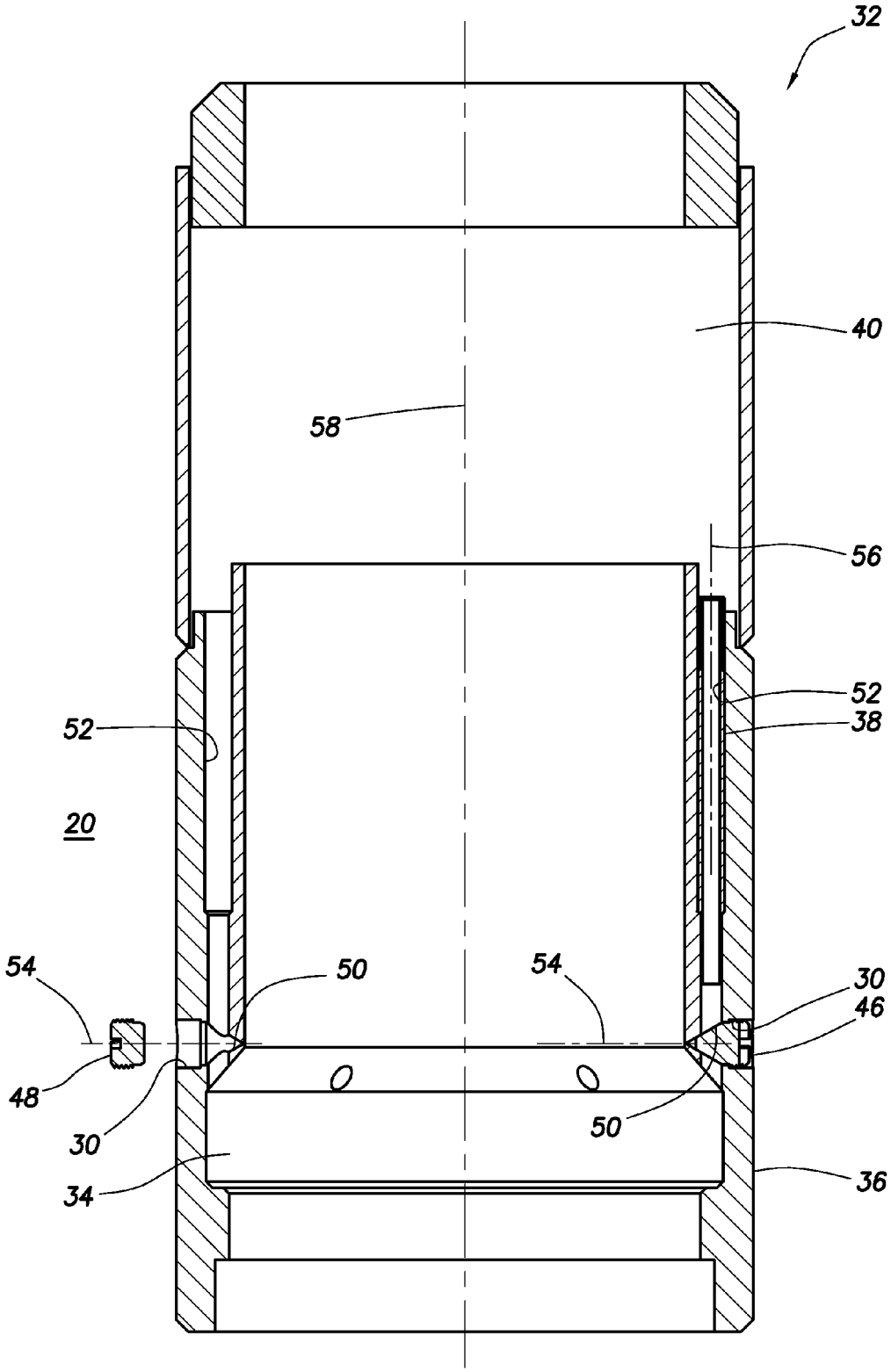
FIG. 3 is a further enlarged scale cross-sectional view of an inflow control device which can embody principles of this disclosure.

Referring additionally now to FIG. 3, the inflow control device 32 is representatively illustrated at an enlarged scale, apart from the screen 28 and base pipe 44 of FIG. 2. In this view, it may be seen that a generally conical tapered metal seat 50 is associated with each of the openings 30.

If a plug 46 is fully installed in one of the openings 30, a generally conical tapered end on the plug will sealingly engage the associated seat 50, preferably forming a metal-to-metal seal which prevents flow of the fluid 12 through the associated tubular structure 38. Although only one tubular structure 38 is depicted in FIG. 3, in practice preferably all of multiple circumferentially spaced apart openings 52 formed longitudinally in the housing 36 are provided with tubular structures.

Note that longitudinal axes 54 of the openings 30, plug(s) 46 (when installed) and closure(s) 48 are substantially perpendicular to longitudinal axes 56 of the tubular structures 38. Preferably, this allows for the plug(s) 46 and closure(s) 48 to be installed in the openings 30 in a radial direction relative to the flow passage 16 or a longitudinal axis 58 of the inflow control device 32.

However, in other examples, the longitudinal axes 54 of the openings 30, plug(s) 46 and closure(s) 48 may not be substantially perpendicular to the respective longitudinal axes 56 of the tubular structures 38. Such non-perpendicular arrangement of these elements could be used, for example, to conserve radial space in the system 10.

Figure 4:
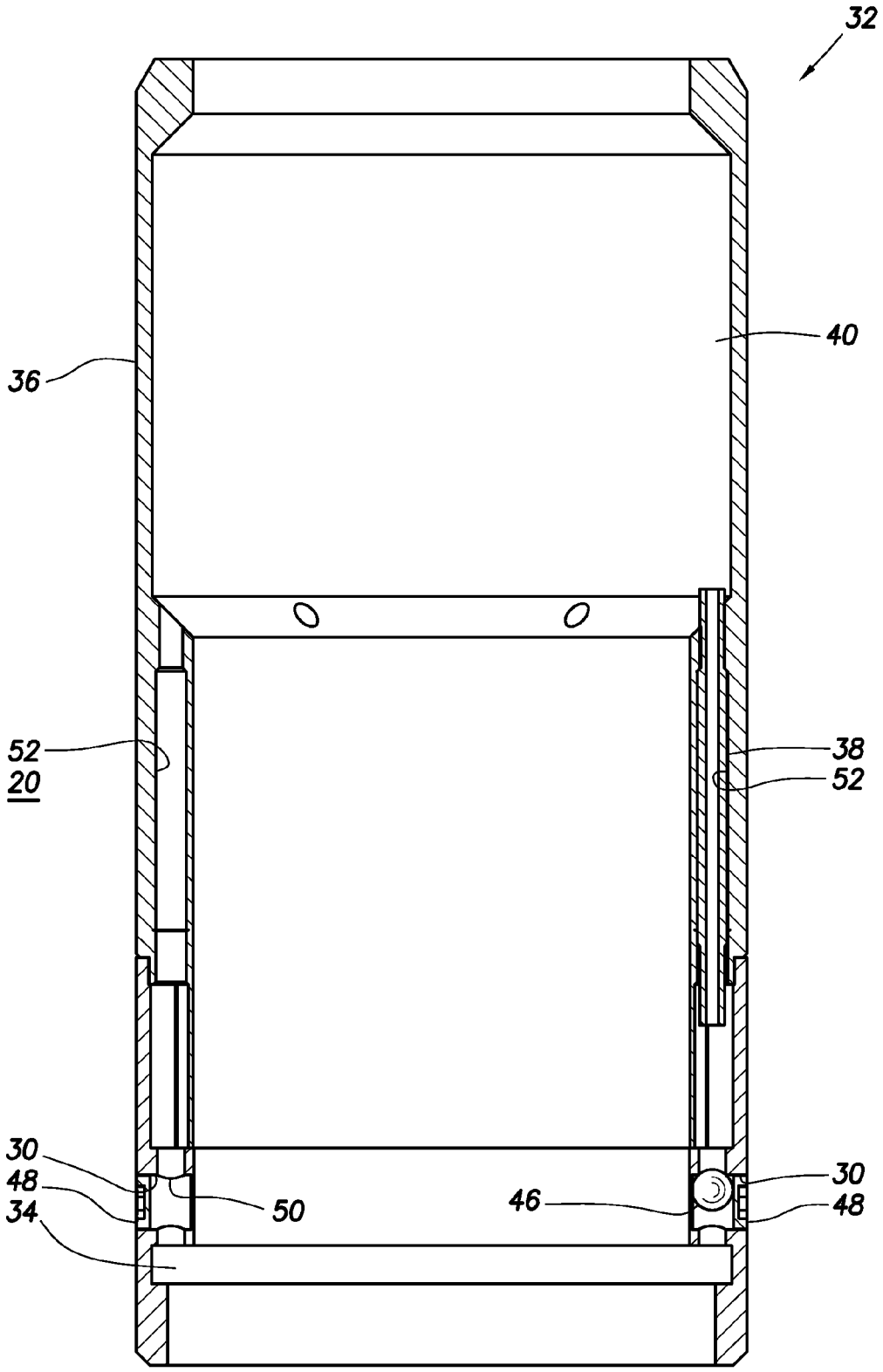
FIGS. 4 & 5 are cross-sectional views of additional configurations of the inflow control device.

Referring additionally now to FIG. 4, another configuration of the inflow control device 32 is representatively illustrated. In this configuration, the plug(s) 46 comprise ball(s).

As depicted in FIG. 4, a plug 46 is retained in the housing 36 by a closure 48. The plug 46 will sealingly engage a seat 50 to thereby prevent flow of the fluid 12 through an associated tubular structure 38.

In this example, a plug 46 (a ball) is placed in the housing 36 upstream of each tubular structure 38 for which it is desired to prevent flow through the tubular structure. A closure 48 is installed in every opening 30.

Figure 5:
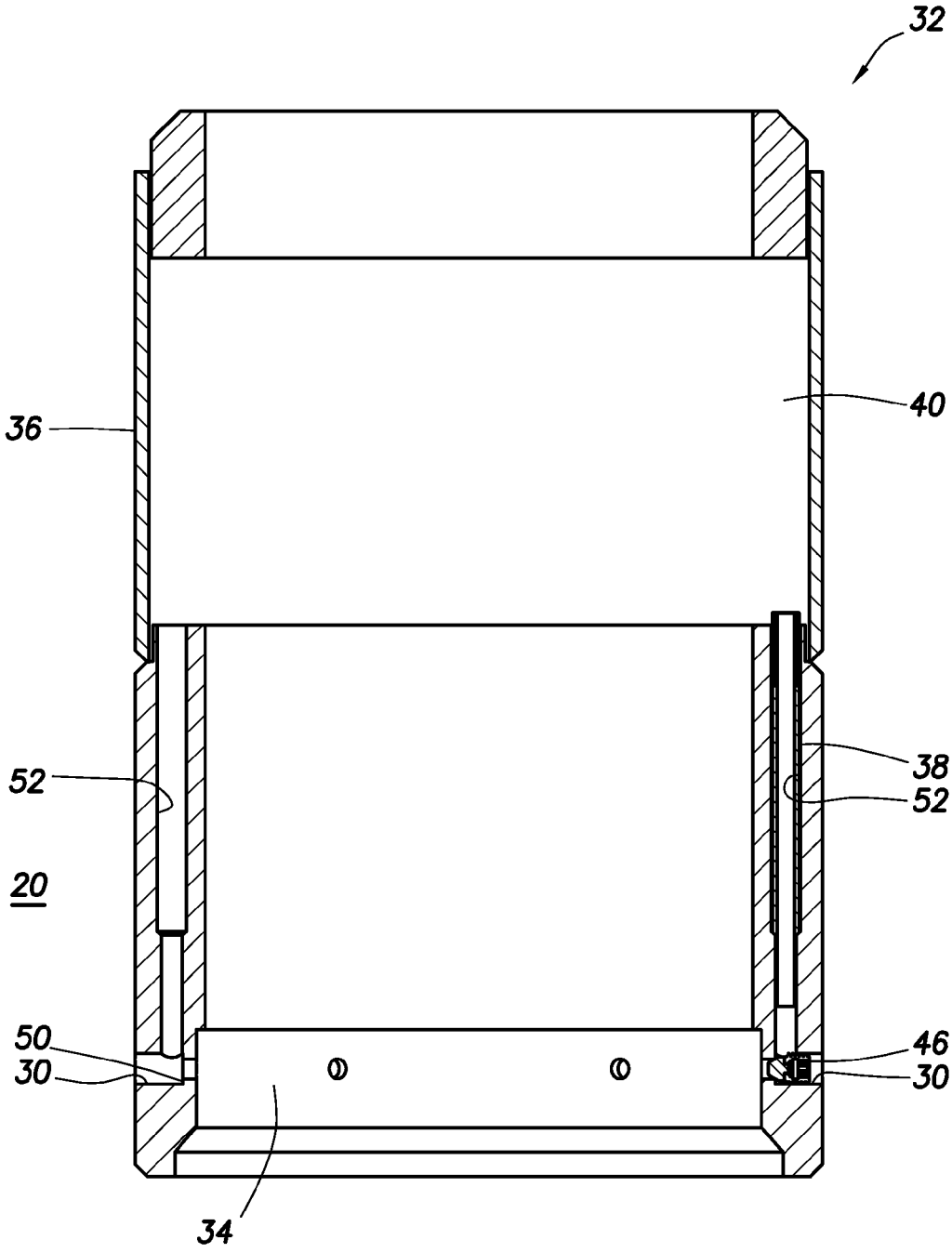

Referring additionally now to FIG. 5, yet another configuration of the inflow control device 32 is representatively illustrated. This configuration is similar in many respects to the FIG. 3 configuration, but differs at least in that the tapered seat 50 of FIG. 3 is replaced by an edge seat in FIG. 5. A tapered end on a commercially available plug 46 can sealingly engage the seat 50 in the FIG. 5 configuration to prevent flow of fluid 12 through the associated tubular structure 38.

The different configurations of FIGS. 3-5 demonstrate that there exists a wide variety of different systems, devices, methods, etc. which can embody the principles of this disclosure. Therefore, it should be understood that the scope of this disclosure is not limited to any particular details of the examples described above.

For example, although only metal-to-metal sealing is described above between the plugs 46 and the seats 50, in other configurations seals may be accomplished with elastomers, plastics, etc., instead of or in addition to metal-to-metal sealing.

It can now be fully appreciated that the above disclosure provides several advancements to the art. In examples described above, the openings 30 in the flow regulating system 10 are readily accessible, so that the plugs 46 and closures 48 can be installed therein as needed to adjust a flow resistance of the system, with no need to remove any covers, disassemble the housing 36, etc.

The above disclosure provides to the art a method of variably restricting fluid 12 flow in a well. In one example, the method can include installing one or more plugs 46 in a selected at least one of multiple openings 30 in a housing 36, each installed plug 46 preventing fluid 12 flow through a respective one of multiple tubular structures 38 (or other types of flow restrictors), and externally accessing the multiple openings 30 in the housing 36, without removing any cover.

The method may also include installing one or more closures 48 in at least one of the openings 30, each installed closure 48 preventing fluid communication between a respective one of the tubular structures 38 and an annulus 20 external to a tubular string 18.

The plugs 46 can comprise one or more balls.

The installing step may include aligning longitudinal axes 54 of the plugs 46 with longitudinal axes 54 of the openings 30. The longitudinal axes 54 of the openings 30 can be substantially perpendicular to longitudinal axes 56 of the respective selected tubular structures 38. The longitudinal axes 54 of the plugs 56 may be substantially perpendicular to longitudinal axes 56 of the respective selected tubular structures 38.

Each installed plug 46 may sealingly engage a respective one of multiple tapered seats 50 in the housing 36.

Also described above is a flow regulating system 10 for use with a subterranean well. In one example, the system 10 can include multiple tubular structures 38, at least one of which selectively restricts flow between an interior of a tubular string 18 and an annulus 20 external to the tubular string 18, at least one plug 46 which prevents flow through one of the tubular structures 38, the plug 46 being aligned substantially perpendicular to a longitudinal axis 56 of the tubular structure 38.

The system 10 can also include at least one tapered seat 50 which sealingly engages the plug 46.

The plug 46 may comprise a ball.

The plug 46 may be externally accessible without removal of any cover.

The system 10 may include at least one closure 48 which prevents direct fluid communication between the annulus 20 and another of the tubular structures 38. The closure 48 may be externally accessible without removal of any cover.

The plug 46 and the closure 48 may be received in openings 30, and each of the openings 30 can have a longitudinal axis 54 which is aligned substantially perpendicular to the longitudinal axis 56 of the respective first or second tubular structure 38.

The openings 30 can be formed in a housing 36, and the openings 30 may be externally accessible on the housing 36, without removal of any cover.

An externally adjustable inflow control device 32 is also described above. In one example, the inflow control device 32 can include a housing 36 having multiple openings 30 formed therein, multiple tubular structures 38 in the housing 36, and one or more plugs 46 in a selected at least one of the openings 30, each plug 46 preventing fluid flow through a respective one of the tubular structures 38, and each plug 46 being externally accessible on the housing 36, without removal of any cover.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of variably restricting fluid flow in a well, the method comprising:

installing one or more plugs in a selected at least one of multiple openings in a housing;

each installed plug being positioned upstream of a respective one of multiple flow restrictors and preventing fluid flow through the respective one of the multiple flow restrictors; and externally accessing the multiple openings in the housing, without removing any cover.

2. The method of claim 1, further comprising installing one or more closures in at least one of the openings, each installed closure preventing fluid communication between a respective one of the flow restrictors and the annulus external to the tubular string.

3. The method of claim 1, wherein the plugs comprise one or more balls.

4. The method of claim 1, wherein the installing step further comprises aligning longitudinal axes of the plugs with longitudinal axes of the openings, and wherein the longitudinal axes of the openings are substantially perpendicular to longitudinal axes of the respective selected flow restrictors.

5. The method of claim 1, wherein the installing step further comprises aligning longitudinal axes of the plugs with longitudinal axes of the openings, and wherein the longitudinal axes of the plugs are substantially perpendicular to longitudinal axes of the respective selected flow restrictors.

6. The method of claim 1, wherein each installed plug sealingly engages a respective one of multiple tapered seats in the housing.

7. The method of claim 1, wherein the flow restrictors comprise tubular structures.

8. A flow regulating system for use with a subterranean well, the system comprising:

multiple flow restrictors, at least one of which selectively restricts flow between an interior of a tubular string and an annulus external to the tubular string;

at least one plug which prevents flow through a first one of the flow restrictors, the plug being aligned substantially perpendicular to a longitudinal axis of the first flow restrictor.

9. The system of claim 8, further comprising at least one tapered seat which sealingly engages the plug.

10. The system of claim 8, wherein the plug comprises a ball.

11. The system of claim 8, wherein the plug is externally accessible without removal of any cover.

12. The system of claim 8, further comprising at least one closure which prevents direct fluid communication between the annulus and a second one of the flow restrictors.

13. The system of claim 12, wherein the closure is externally accessible without removal of any cover.

14. The system of claim 12, wherein the plug and the closure are received in openings, and wherein each of the openings has a longitudinal axis which is aligned substantially perpendicular to the longitudinal axis of the respective first or second flow restrictor.

15. The system of claim 14, wherein the openings are formed in a housing, and wherein the openings are externally accessible on the housing, without removal of any cover.

16. The system of claim 8, wherein the flow restrictors comprise tubular structures.

17. An externally adjustable inflow control device, comprising:

a housing having multiple openings formed therein;

multiple flow restrictors in the housing;

one or more plugs in a selected at least one of the openings, each plug preventing fluid flow through a respective one of the flow restrictors, and each plug being externally accessible on the housing, without removal of any cover, wherein each plug is disposed in a flow passage between a screen and the respective one of the flow restrictors.

18. The inflow control device of claim 17, further comprising one or more closures in at least one of the openings, each installed closure preventing fluid communication between a respective one of the flow restrictors and an exterior of the inflow control device.

19. The inflow control device of claim 17, wherein the plugs comprise one or more balls.

20. The inflow control device of claim 17, wherein longitudinal axes of the plugs are aligned with longitudinal axes of the openings, and wherein the longitudinal axes of the openings are substantially perpendicular to longitudinal axes of the respective selected flow restrictors.

21. The inflow control device of claim 17, wherein the longitudinal axes of the plugs are aligned with longitudinal axes of the openings, and wherein the longitudinal axes of the plugs are substantially perpendicular to longitudinal axes of the respective selected flow restrictors.

22. The inflow control device of claim 17, wherein each plug sealingly engages a respective one of multiple tapered seats in the housing.

23. The inflow control device of claim 17, wherein the flow restrictors comprise tubular structures.

* * * * *